United States Patent [19]

Nakajima

[11] Patent Number: 4,777,988

[45] Date of Patent: Oct. 18, 1988

[54] READING DEVICE FOR DOBBY

[75] Inventor: Toshio Nakajima, Ohsaka, Japan

[73] Assignee: Murata Kikai Kabushiki Kaisha, Kyoto, Japan

[21] Appl. No.: 775,796

[22] Filed: Sep. 12, 1985

[30] Foreign Application Priority Data

Sep. 18, 1984 [JP] Japan ..... 59-196371

[51] Int. Cl.[4] ..... D03D 51/00

[52] U.S. Cl. ..... 139/324; 139/329; 139/68

[58] Field of Search ..... 139/329, 324, 1 E, 68, 139/325, 71, 72, 74

[56] References Cited

U.S. PATENT DOCUMENTS

| | | | |
|---|---|---|---|
| 4,067,364 | 1/1978 | Tomio | 139/1 E |
| 4,250,930 | 2/1981 | Palau et al. | 139/324 |
| 4,351,368 | 9/1982 | Palau | 139/324 |
| 4,386,631 | 6/1983 | Mizaguchi | 139/68 |
| 4,448,220 | 5/1984 | Zwiener et al. | 139/1 E |

FOREIGN PATENT DOCUMENTS

| | | | |
|---|---|---|---|
| 3044210 | 6/1982 | Fed. Rep. of Germany | 139/329 |
| 649032 | 1/1951 | United Kingdom | 139/1 E |

*Primary Examiner*—Harvey C. Hornsby
*Assistant Examiner*—Joseph S. Machuga
*Attorney, Agent, or Firm*—Spensley Horn Jubas & Lubitz

[57] ABSTRACT

A reading device for use in a dobby having a peg cylinder connected to a heddle frame for operation thereof comprises a first bracket, a second bracket, a means for permitting physical contact between the first and second brackets and device to oscillate the second bracket so that the peg cylinder supported on the first bracket is moved to any of a normal, reversed and leveling positions.

8 Claims, 4 Drawing Sheets

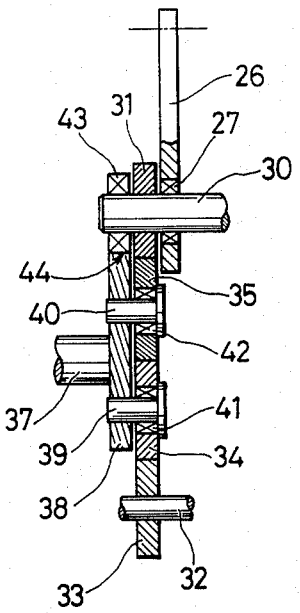
FIG. 3
FIG. 4
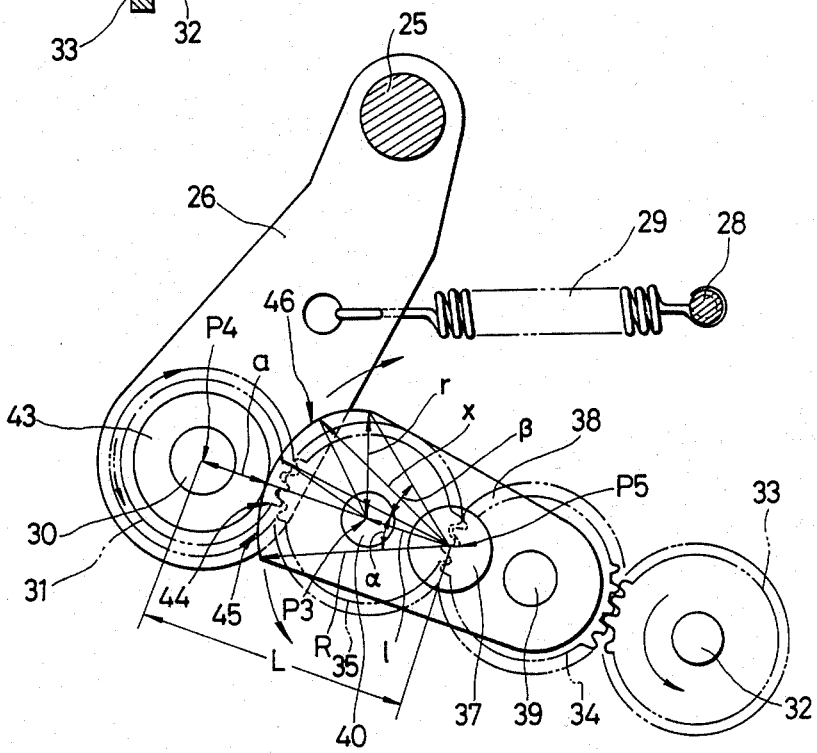

READING DEVICE FOR DOBBY

BACKGROUND OF THE INVENTION

1. Field of the Invention

The present invention relates to a reading device for use with dobbys.

2. Prior Art

In a dobby equipped loom, it may happen that the weft thread that has newly been passed through the warp threads breaks as a result of one thing or another. If this occurs, in order to keep the pattern of fabric in a flawless, uniform condition, the broken thread must be removed and replaced with a new weft thread. To do this, the loom is stopped and the dobby is manipulated back to the reading position at which the breakage took place. The cylinder on which the pattern cards or the pegs for the control of the pattern are carried is reversed for one pick and the loom is inched backward until the shed in which the broken thread is engaged is opened enough to release it. This is called "reverse operation". After the broken thread has been removed, the cylinder is rotated back to the normal operating position and the weaving is resumed.

Apart from this operation for a broken weft thread to be removed, separate adjustments may be performed in the shed and the warp threads. This is done by lowering or raising the different groups of heddle frames to align them at the given heights. This operation, called "levelling", in some of the prior art dobby equipped looms in which the peg cylinder is displaceable from operating position, is carried out, with the peg cylinder being moved away out of normal engagement with the associated pegs so that the peg cylinder will not be interferred during the leveling.

However, in those conventional devices in which the peg cylinder is displaceable, reversal tends to result in the peg cylinder being accidentally displaced off center, causing the engaging hooks to improperly engage with the associated pegs. For normal weaving operation, the pegs should impart precise control to the engaging hooks in timed engagement therewith to thereby raise or lower the different groups of heddle frames which in turn allow the warp threads to interweave the weft threads to produce a desired pattern. Therefore, if the engagement of a peg with its associated pair of engaging hooks goes out of order, then the entire operation is seriously impaired.

SUMMARY OF THE INVENTION

An object of the present invention is to provide a reading device for a dobby in which a peg cylinder can be reversed in a position that is substantially the same as the normal operating position and, on the other hand, in the position where the peg cylinder permits reversal, the peg and the leading levers are maintained invariably in the operating position.

The present invention is directed to a reading device for use in a dobby having a peg cylinder connected to a heddle frame for operation thereof and a driving shaft connected to the drive of a loom and adapted to operate the peg cylinder, comprising a first bracket pivotally disposed at its one end on a first shaft for oscillation about said first shaft and having a shaft secured to the other end thereof, said shaft being adapted to rotatably support said peg cylinder thereon, a second bracket secured at its center on a second shaft and supported for oscillation on a frame and having a mechanical power transmission means thereon, said mechanical power transmission means being connected in such a manner as to transmit the rotary motion of said driving shaft to said peg cylinder, and a mechanical motion guide means which permits contact for guiding the motion between said first bracket and said second bracket along a range of contact surface, the contour of said range being described by a radius having the center at the axis of said second pivot.

Reversal of the peg cylinder is effected by oscillating the second bracket about the center of the second shaft through the given angle. This reversal is attained without the first bracket being displaced so that the normal engagement relation between the peg and associated engaging hook pair is maintained. For leveling, the second bracket is oscillated in such a direction through a predetermined angle to bring the first bracket into abutment on the second bracket at a point on the arc (aforesaid range of surface) having the center at the axis of the second shaft, whereby the peg cylinder is moved away enough to bring the peg out of normal operating engagement with the associated engaging peg pair.

According to the present invention, it is possible to reverse the peg cylinder in a safe and assured manner. This is because, on the one hand, the peg cylinder can be reversed in a position that is substantially the same as the normal operating position and, on the other hand, in the position where the peg cylinder permits reversal, the peg and the leading levers are maintained invariably in the operating position while the engaging hooks are in proper engagement with the rocking hooks.

BRIEF EXPLANATION OF THE DRAWINGS

FIG. 3 is an expansion plan showing the device of FIG. 2;

FIG. 4 is an enlarged front view showing part of one embodiment of the present invention;

DETAILED DESCRIPTION OF THE INVENTION

Figure 1:
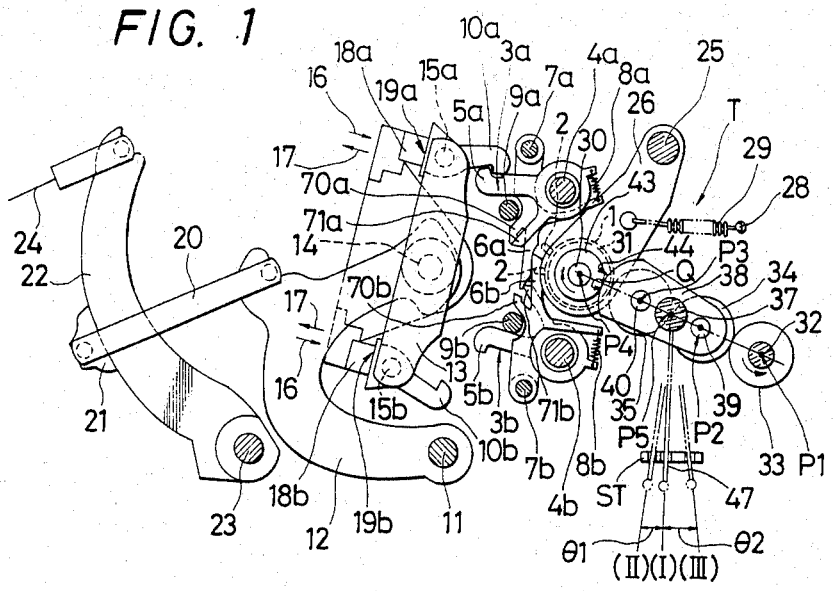
FIG. 1 is a schematic front view showing the construction of a dobby equipped with the device according to the present invention.

FIG. 1 is a view showing in schematic form the construction of a dobby equipped with the device according to the present invention.

A pair of leading levers 6*a* and 6*b* are pivotally disposed on respective stationary pins 7*a* and 7*b* for free rotation between the two alternative positions that are determined by the rotational position of a peg 2 secured to the outside surface of a peg cylinder 1. Engaging hooks 3*a* and 3*b* which are rotated according to the rotation of the leading levers 6*a* and 6*b* are also pivotally disposed on the other stationary pins 4*a* and 4*b*. The engaging hooks 3*a* (3*b*) includes a hook lever 5*a* (5*b*) in one body at the end porting thereof. A spring 8*a* is interconnected between the leading lever 6*a* and the engaging hook 3*a* so that the leading lever 6*a* and the engaging hook 3*a* are substantially operated integrally. Another spring 8*b* is interconnected between the leading lever 6*b* and the engaging hook 3*b* in the same manner as the above. A pair of stoppers 9a and 9b are provided to stand adjacent to the hook levers 5a and 5b, respectively, so that the engaging hooks 3a and 3b are prevented from rotation beyond the point where their associated hook lever comes into contact with the respective stopper.

The spring 8a urges a slider 70a of the leading lever 6a in a direction close to an arm 71a of the engaging hook 3a and urges the leading lever 6a and engaging hook 3a in the counterclockwise direction about the pin 7a and the pin 4a, respectively. A slider 70b and an arm 71b are urged by a spring 8b in the clockwise direction about the pin 7b and the pin 4b in the same manner.

A balk lever 12 is pivotally disposed at its one end on a fixed pin 11 for free rotation, and is formed at its opposite free end with a pin 14, on which a balk 13 is rotatably mounted at its center for free rotation. The balk 13 are provided at both ends with stationary pins 15a and 15b, respectively, on which the rocking hooks 10a and 10b are pivotally disposed for rocking into engagement with and disengagement from the corresponding hook levers 5a and 5b.

A pair of push bars 18a and 18b are movably disposed for reciprocation in the directions indicated by arrows 16 and 17, and alternatively move forward to push the back faces 19a and 19b of the rocking hooks 10a and 10b, upon being actuated by a shaft (not shown) of the dobby interlocked with the loom, whereby the rocking hooks 10a and 10b oscillate to advance in turn into engagement with the hook levers 5a and 5b. Along with this oscillatory motion of the hook levers 5a and 5b, the balk 13 moves to and for, causing the balk lever 12 to rotate clockwise and back through the given angle about the pivot at the pin 11 through the pin 14. To illustrate with reference to FIG. 1, when the push bar 18b moves forward to push the back side 19b of the rocking hook 10b, the balk 13 advances allowing the rocking hook 10b to engage the hook lever 5b. This forward movement of the balk 13 causes also the balk lever 12 to rotate clockwise through the pin 14 to which its free end is secured. This clockwise rotation of the balk lever 12 causes a jack lever 22, which is pivoted on a fixed pin 23, to rotate in the clockwise direction through a link 20 withdrawing a cord 24 interconnected between the jack lever 22 and a heddle frame (not shown). This withdrawal of the cord 24 raises, or lower if the cord is connected through an intermediate lever, lowers the heddle frame. On the contrary, when the jack lever 22 is rotated anticlockwise, the heddle frame is allowed to lower (or rise) through a suitable mechanism such as a spring arrangement. In this way, shedding of the warp threads is achieved. The aforesaid link 20 is secured at its end to an adjuster 21 that is mounted on the jack lever 22.

Operation of the read means T which controls the aforesaid engaging hooks 3a and 3b will be described in full detail with reference to FIGS. 1 through 4.

Figure 2:
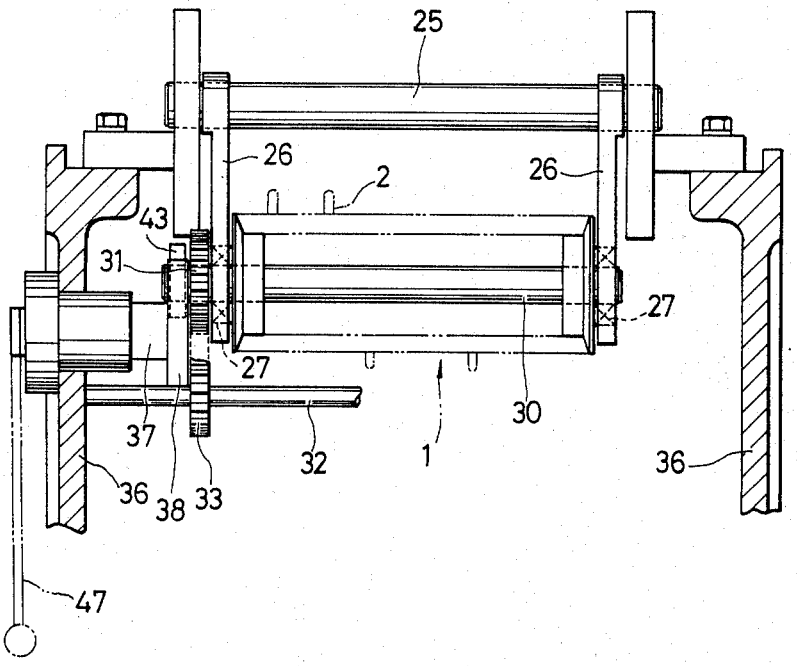
FIG. 2 is a side view of the reading device.
Figure 1A:
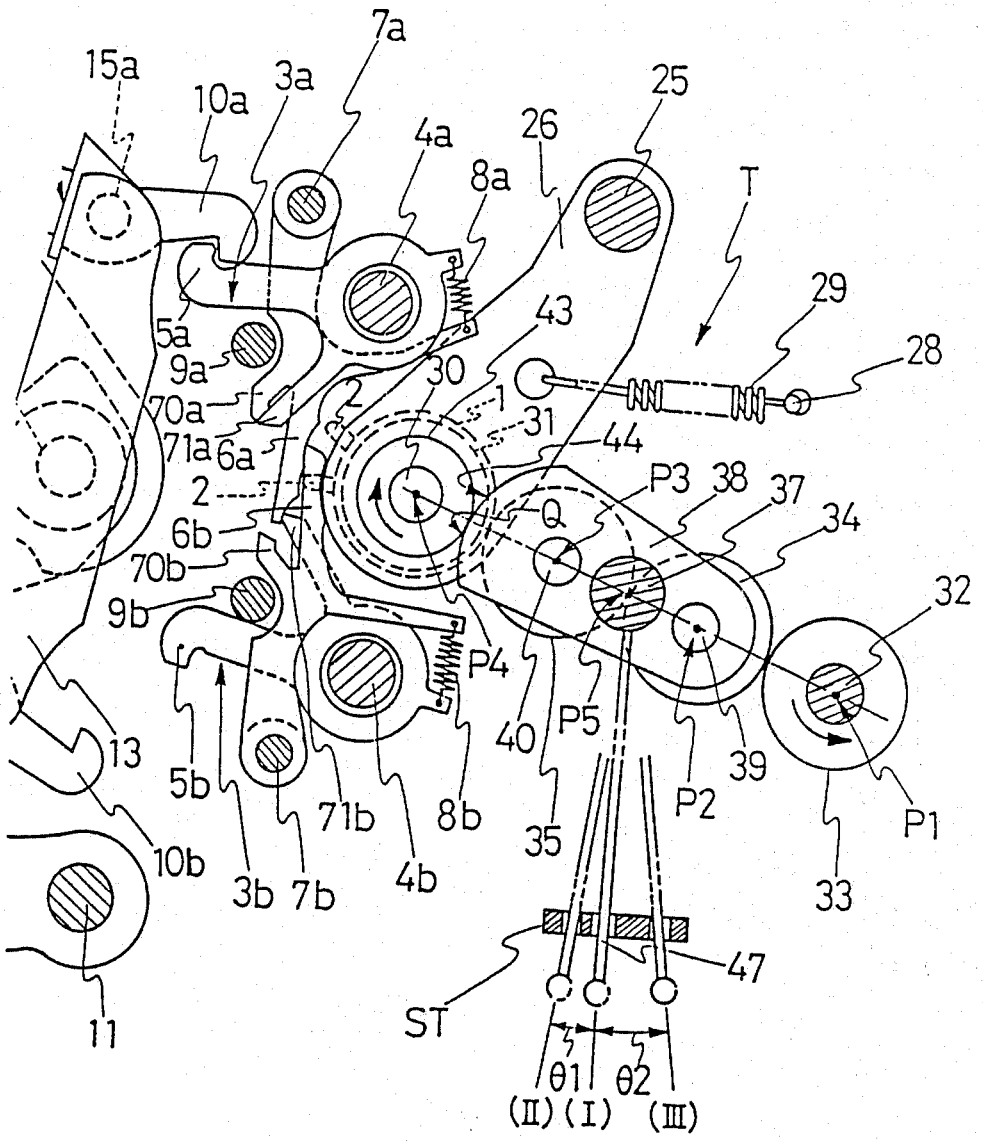
FIG. 1*a* is a magnified view of a portion of FIG. 1.

Referring first to FIGS. 1 and 2, the peg cylinder 1 having the peg 2 implanted in the outside surface thereof is supported on bearings 27 in a first bracket 26, which is pivotally disposed on a first shaft 25. A tension spring 29 is provided secured at its one end to a fixed pin 28 and at the opposite end to one side plate of the first bracket 26 such that the bracket 26 is urged in the anticlockwise direction. The cylinder 1 is supported on a rotatable shaft 30, which has its one end secured to a gear wheel 31 for rotation therewith. The gear wheel 31 is connected in mesh engagement with a driving gear 33 through an intermediate pair of gear wheels 34 and 35. The driving gear 33 is rotatably mounted on a fixed shaft 32 and is interlocked to the loom which drives the gear 33. The rotary motion of the driving gear 33 is transmitted to the peg cylinder 1 through the gear wheel 31.

The intermediate gear wheels 34 and 35 are supported together in a second bracket 38, rotatably disposed on respective shafts 39 and 40 journaled on bearings 41 and 42 for free rotation, though opposite in their rotational direction. The second bracket 38 is secured on a shaft 37 that is turnably supported between the gear wheels 34 and 35 on a mounting frame 36. This gearing arrangement comprising the gears 33, 34, 35 and 31 connected in mesh engagement may be superceded by any other suitable system such as an arrangement of pulleys and transmission belt or sprockets and endless chain in other embodiments according to the present invention, providing it is designed to transmit the rotary motion of the shaft 32 to the peg cylinder 1.

It is also designed so that normal operation of the invention brings about alignment of all of the centers P1, P2, P3 and P4 of the gears 33, 34, 35 and 31 with the center P5 at the pivot 37 of the second bracket 38, as shown in FIG. 1.

The second bracket 38, which is rotatably disposed on its shaft 37, is formed at the periphery of its one end with a cam surface 44 for cam action in abutting engagement Q with a cam follower 43 provided in the periphery of the bearing at one end of the shaft 30 for the peg cylinder 1. The cam surface 44 is formed to include a range 45 of contour for the cam follower 43 to follow when the peg cylinder 1 is moved to the reversed position. This range 45 is an arc of a circle having its center at the axis of the shaft 37 for the second bracket 38. Consequently, the first bracket 26 maintains the peg cylinder 1 at a given constant distance from the shaft 37, as measured from the axis of the shaft 30 to P5 or the axis of the shaft 37, when the cam surface 44 is abutted on the cam follower 43 at any point on this range 45.

The contour of the cam surface 44 formed on the second bracket 38 will be described in further detail with reference to FIG. 4. The cam surface 44 comprises a first arc portion 45 and a second arc portion 46. The first arc portion 45 is represented by the curve of the sector with radius "R", swept by the angle $\alpha$, having its center at P5 or the axis of the pivot 37 and is substantially equivalent to the aforesaid range 45. The second arc portion 46, on the other hand, is described by the radius "r" within the angle $\beta$ having the center at P3 or the axis of the intermediate gear wheel 35. Hence, $R > r$. The arrangement of this dual arc contour for the cam surface 44 will be described.

When the cam surface 44 is in contact with the cam follower 43 at any point on the first arc portion 45, the relation of the distance "L" between P4 and P5 with the radius "R" of the first arc portion 45 is represented by the formula $$L = a + R$$

where "a" is the radius of the cam follower 43. On the other hand, when the cam surface 44 is abutted on the cam follower 43 at the second arc portion 46, distance L1 between P4 and P5 is given by the following formula $$L1 = a + x$$

where $x \leqq r+l$, $l$=distance between P5 and P3. Consequently, $L \geqq L1$, since $x \leqq R$. It follows that, when the cam surface 44 is in contact with the cam follower 43 at any point on the second arc portion 46 where $L > L1$, the shaft 30 of the peg cylinder 1 is closer to the shaft 37 than when they are engaged with each other at the first arc portion 45 where $L = L1$. The contour of the second arc portion 46 may be straight or any other curve, providing the formula $L > L1$ is met. It is important that the peg 2 is provided on the cylinder 1 such that, when the cam follower 43 is abutted on the second arc portion 46 of the cam surface 44, the peg 2 is not engaging with and completely clear out of either one of the leading levers 6*a* and 6*b*.

The means to oscillate the second bracket 38 about its shaft 37 may be a lever 47, as shown in the illustrated embodiment (FIGS. 1 and 2). The lever 47 is secured to the pivot 37 and is swung between three positions to oscillate the latter, the reversed position II, the normal position I and the leveling position III. The reversed position II is swung through the angle $\theta 1$ and the leveling position III is through the angle $\theta 2$ with respect to the normal position I. When the lever 47 is swung to the leveling position III, the cam follower 43 comes into contact with the second arc portion 46 of the cam surface 44. On the other hand, the cam surface 44 is abutted at the first arc portion 45 on the cam follower 43 in the reversed position II of the lever 47.

Figure 5:
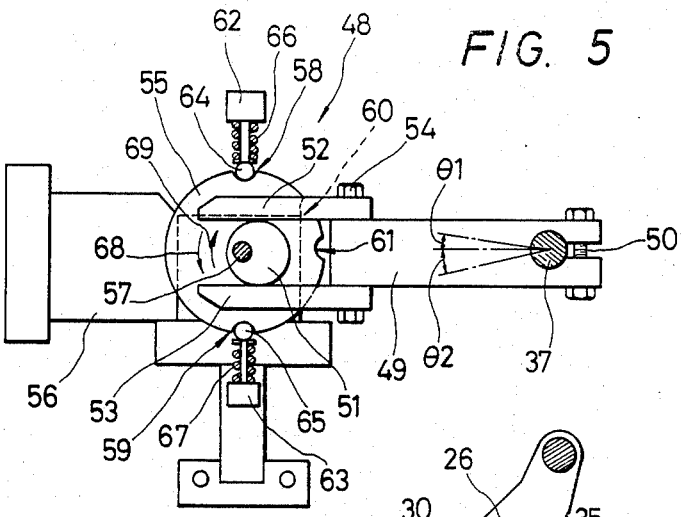
FIG. 5 is an alternative oscillating device for the second bracket.

The means to oscillate the secodd bracket 38 may be a device 48 as shown in FIG. 5. A pivotal lever 49 is secured to one end of the shaft 37 by means of a bolt 50 for oscillation of the second bracket 38 through the shaft 37 made integral therewith. The other end of the pivotal lever 49 is provided at its either side with contact members 52 and 53 mounted to face each other and secured to the pivotal lever 49 by means of a bolt or bolts at 54. Interposed between the contact members 52 and 53 is provided an eccentric cam 51 that is abutted at its opposite ends on the contact members 52 and 53. The eccentric cam 51 is made integral with a disk 55, mounted with their centers offset from each other. The disk 55 is secured at its center to the driving shaft 57 of a motor 56 which rotates the disk in either direction together with the eccentric cam 51. In the periphery of the disk 55 is formed four recesses 58, 59, 60 and 61. The recesses 58 and 59 are provided for the disk 55 to take the normal position equivalent to the position I of the lever 47 of FIG. 1. The recess 60 is for the reversed position whereas the recess 61 is for the leveling position. Similarly, they correspond to their counterparts of the lever 47 and are used to bring the cam follower 43 to contact with the first arc portion 45 or second arc portion 46 of the cam surface 44. Actuators 64 and 65 are provided for positioning the disk by entering the particular recess 58, 59, 60 or 61 and provided respectively with springs 66 and 67. Each of the actuators 64 and 65 is connected at the opposite end with a microswitch 62 (63). The illustrated position is taken by the disk 55 during normal weaving operation, with the actuators being situated in the recesses 58 and 59. When the motor 68 is energized to rotate the disk in the direction indicated by the arrow 68 until the recess 60 reaches the actuator 64, where the motor 68 is deenergized by the microswitch 62, the cam 51 causes the pivotal lever 49 to oscillate through an angle $\theta 1$ through the contact members 52 and 53. This position sets the peg cylinder 1 in the reversed position by oscillating the pivot 37 through the same degrees of angle.

To obtain the leveling position of the peg cylinder 1, on the other hand, the motor 68 is activated to turn the disk in the direction indicated by the arrow 69 to bring the recess 61 over to the actuator 65. Whereby the pivotal lever 49 is oscillated from the normal position through an angle of 82 through the cam 51. This sets the peg cylinder 1 in the leveling position.

Operation of the present invention will be described with reference to the preferred embodiment mentioned above.

Referring first FIG. 1, during normal weaving operation of the loom, the lever 47 is in the normal position I, where the cam follower 43 in the first bracket 26 falls in abutment with the first arc portion 45 of the cam surface 44. All of the gears 33, 34, 35 and 31 stand with their centers P1, P2, P3 and P4 situated in alignment. The peg cylinder 2 is driven to cause the peg 2 into alternative engagement with the leading levers 6*a* and 6*b* and, thus, the shedding is kept up.

Figure 6A:
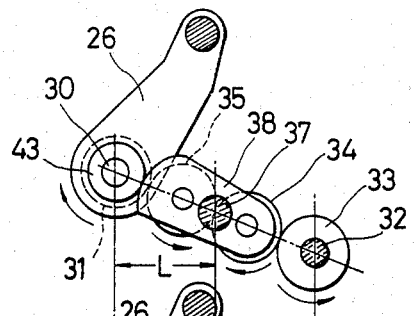
FIGS. 6*a*, 6*b*, and 6*c* are views showing the normal, reversed, and leveling positions of the peg cylinder.
Figure 6B:
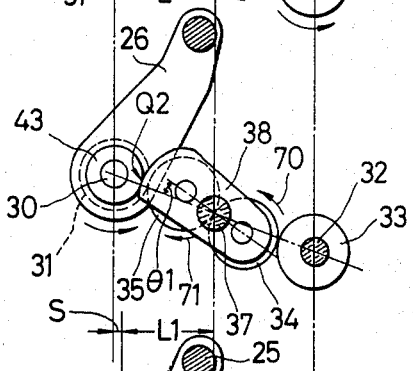

If the weft thread breaks, the dobby is stopped together with the loom. First, the weft thread that is cast following the broken one is removed. The lever 47 is swung from the normal position I to the reversed position II, the position of view of FIG. 6*b*, whereby the second bracket 38 is oscillated through the angle $\theta 1$. Since gear 33 mounted on the driving shaft 32 is locked (the loom being stopped), this oscillation of the second bracket 38 causes the gear wheel 34 to rotate in the direction indicated by the arrow 70 which in turn rotates the gear wheel 35 in the direction of the arrow 71 (view of FIG. 6*b*). As a result, the gear 31 of the shaft 30 has a counterclockwise direction in FIG. 6. The cam follower 43 comes to contact with the cam surface 44 at a point Q2 that is within the contour of the first arc portion 45 so that the distance L between the axis of the shaft 30 and the shaft 37 remains the same as in the normal position as depicted in view of FIG. 6*a*. Consequently, the relative position of the peg 2 with the leading levers 6*a* and 6*b* remains unchanged. The aforesaid angle $\theta 1$ is selected as the degrees for the peg cylinder 1 to rotate backward for a single "pick" and varies depending on the diameter of the cylinder 1 and the number of teeth of each gear 33, 34, 35 and 31.

With the peg cylinder 1 in this reversed position II, the appropriate switch on the loom is operated to inch the shedding harness in the backward direction to open the shed where it is possible to release the broken weft thread from the warp threads already woven into the fabric.

Figure 6C:
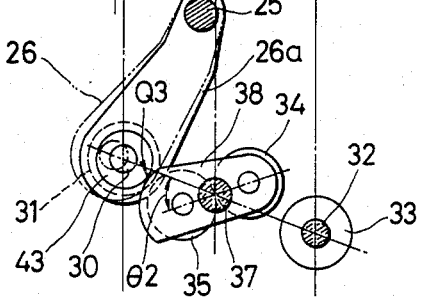

When the lever 47 is swung from the position of FIG. 1 to the position III of view of FIG. 6*c*, the second bracket 38 is oscillated counterclockwise to the illustrated position (view of FIG. 6*c*) where the cam follower 43 is contacted with the cam surface 44 at Q3 that is situated on the second arc portion 46. The first bracket 26 is oscillated to the position depicted in solid line, bringing the shaft 30 to move closer to the shaft 37. The peg cylinder 1 is also moved to the right for distance S in view of FIG. 6*c*, moving the peg 2 away from the leading levers 6*a* and 6*b*, whereby the peg 2 ceases to engage therewith. Then, all of the hook levers 5*a* and 5*b* and rocking hooks 10*a* and 10*b* are disengaged with each other when the switch on the loom is operated to inch. Thereupon, the hooks levers 5*a* and 5*b* are rotated by the action of the associated springs 7*a* and 7*b* to come into abutment on the respective stoppers 9*a* and 9*b*. This places the engaging hooks 3*a* and 3*b* out of engagement with the rocking hooks 10*a* and 10*b*. Consequently, the heddle frames (not shown) connected to the associated balk 13 through the balk lever 12 are held at the given height. When the peg cylinder 1 is in the leveling position, the second bracket 38 is rotated far enough to bring the intermediate gear wheels 34 and 35 out of engagement with the gear 33 so that the peg cylinder 1 is placed free to rotate so that change of pegs 2 or peg cards can be carried out easily.

Operation of the means 48 of FIG. 5 will be described, which may be employed instead of the lever system explained above. Referring then to FIG. 5, when the appropriate switch is turned on to run the motor 56, which is a reversible motor, in the reversed direction, the disk 55 is rotated along with the eccentric cam 51 in the direction indicated by the arrow 68. When the actuator 64 comes into engagement with the recess, the motor 56 is stopped by the microswitch 62, where the pivotal lever 49 is oscillated through the angle $\theta 1$ to bring the peg cylinder 1 into the position that is equivalent to the position of view of FIG. 6*b*. To obtain the position of view of FIG. 6*c*, the other switch of the motor 56 is turned on to bring the actuator 65 into engagement with the recess 61. Compared with the mechanism using the lever 47, the means 48 is easier to operate since the operations involved are with switches.

To bring the loom and dobby back to operation, after removal of the broken weft thread, the lever 47 is oscillated from the position II to normal position I (FIG. 1). This causes the peg cylinder 1 to rotate in the normal direction for one "pick". Then, the start button is turned on to activate the loom which starts over the operation with a new weft thread that substitutes the broken thread. Consequently, the pattern of the fabric is not only undamaged but also maintained into a continued weave, with the weft threads beaten into positions, regardless of the thickness of the cloth. Moreover, continued weaving operation is proceeded in optimum synchronization with beating of the weft threads.

In this embodiment, the cam surface is formed on the second bracket 38 and the cam follower is on the first bracket 26. However, this is a matter of choice and they may be reversed. The distance separated by the peg 2 from the leading levers in the leveling position can be selected to any desired value by changing the contour of the cam surface. Also, the number of intermediate gears between the driving shaft 32 and the peg cylinder 1 may be increased depending on the distance between them, providing the directions of rotation at both ends are proper for the purpose of this invention.

What is claimed is:

1. A reading device for a dobby having a peg cylinder on which pegs for control of a pattern are carried, leading levers being rotatable between two alternative positions by the pegs, engaging hooks having hook levers rotated according to the rotation of the leading levers and a motion transmitting means including rocking hooks which are operable to engage the hook levers of the engaging hooks, said reading device comprising:

a first bracket which is pivotally disposed on a first fixed shaft at one end thereof and which rotatably supports a shaft of the peg cylinder at the other end thereof, said first bracket having an engagement surface associated therewith, a second bracket which is secured on a second shaft at the central portion thereof, said second shaft being turnably supported on a frame, abutment means for permitting abutting engagement between said engagement surface associated with said first bracket and said second bracket, and turning means connected to the second shaft for turning the second bracket so that the peg cylinder is moved to any of a normal, reversed and leveling positions, said abutment means further comprising:

a cam follower provided at one end of the shaft of the peg cylinder supported on the first bracket, and a cam surface provided at the periphery of one end of the second bracket, said cam surface including a first cam surface portion in the form of an arc of a circle having its center at the axis of the second shaft, the first cam surface portion being constructed so that the first bracket maintains the peg cylinder at a given constant distance from the second shaft while the second bracket is turned to move the peg cylinder to the reversed position, wherein said cam surface further includes a second cam surface portion which is formed continuously with the first cam surface portion, the second cam surface portion being constructed so that the distance between the peg cylinder and the second shaft is gradually decreased as the cam follower progresses along the second cam surface portion.

2. A reading device as claimed in claim 1, wherein said reading device further includes a driving shaft and means for transmitting the rotation of the driving shaft to the peg cylinder, said means for transmitting rotation comprising:

a first gear fixed to the driving shaft, a fourth gear fixed at one end of the shaft of the peg cylinder and a second gear and a third gear which are arranged between the first gear and the fourth gear and which are rotatably supported on the second bracket.

3. A reading device as claimed in claim 2, wherein said first and second gears are meshed, said second and third gears are meshed, and said third and fourth gears are meshed and all of said gears and the second shaft of the second bracket stand with their centers situated in alignment while the peg cylinder is at the normal position.

4. A reading device as claimed in claim 2, wherein in said reversed position of the peg cylinder, the first gear is stopped and the second bracket is turned about the center of the second shaft to rotate the peg cylinder in a reverse direction by the device for turning the second shaft, whereby the first cam surface portion is contacted by the cam follower of the first bracket and the distance between the center of the second shaft and the shaft of the peg cylinder is maintained constant.

5. A reading device as claimed in claim 2 further comprising means for enabling movement of said first bracket during disengagement of the first and second gear, wherein in said leveling position of the peg cylinder, the second bracket is turned about the center of the second shaft such that the second cam surface portion comes into contact with the cam follower of the first bracket, whereby the first gear is disengaged from the second gear to decrease the distance between the center of the second shaft and the shaft of the peg cylinder, and pegs on the peg cylinder are disengaged from the leading levers.

6. A reading device for a dobby having a peg cylinder on which pegs for control of a pattern are carried, leading levers being rotatable between two alternative positions by the pegs, engaging hooks having hook levers rotated according to the rotation of the leading levers and a motion transmitting means including rocking hooks which are operable to engage the hook levers of the engaging hooks, said reading device comprising:

a first bracket which is pivotally disposed on a first fixed shaft at one end thereof and which rotatably supports a shaft of the peg cylinder at the other end thereof, said first bracket having an engagement surface associated therewith, a second bracket which is secured on a second shaft at the central portion thereof, said second shaft being turnably supported on a frame, abutment means for permitting abutting engagement between said engagement surface associated with said first bracket and said second bracket, and turning means connected to the second shaft for turning the second bracket so that the peg cylinder is moved to any of a normal, reversed and leveling positions, wherein said turning means comprises:

a pivotal lever secured to the second shaft, an eccentric cam connected with a driving source, contact members which are securely provided at both sides of the pivotal lever and which contact therebetween opposing sides of the eccentric cam, a disk which is integral with the eccentric cam and in which is formed a first recess for the normal position, a second recess for the reversed position and a third recess for the leveling position, and a microswitch having actuators for positioning the disk by entering a particular one of said recesses.

7. A reading device for a dobby having a peg cylinder rotatable about a first axis, said device comprising:

a first engagement surface associated with the peg cylinder, transfer means for transferring rotational energy to the peg cylinder, the transfer means being rotatable about a second axis to any one of a first position for normal operation of the peg cylinder, a second position for reverse operation of the peg cylinder, and a third position for leveling operation of the peg cylinder, a second engagement surface associated with the transfer means, the first engagement surface and the second engagement surface being in abutting engagement, the first engagement surface and the second engagement surface being mutually configured so that the distance between the first axis and the second axis remains substantially constant as the transfer means is rotated from the first position to the second position, wherein the first engagement surface is a cam follower and the second engagement surface is a cam surface and wherein the cam surface further comprises:

a first cam surface portion having an arc of a first radius, a second cam surface portion having an arc of a second radius, the first cam surface portion abutting the cam follower during rotation of the transfer means between the first position and the second position, and the second cam surface portion abutting the cam follower during rotation of the transfer means between the first position and the third position.

8. A device as in claim 7 wherein the first radius is greater than the second radius.

* * * * *